US005344387A

United States Patent [19]

Lupin

[11] Patent Number: 5,344,387

[45] Date of Patent: Sep. 6, 1994

[54] COCHLEAR IMPLANT

[76] Inventor: Alan J. Lupin, 777 Mountjoy Avenue, Victoria, British Columbia, Canada, V8S 4L1

[21] Appl. No.: 112,220

[22] Filed: Aug. 27, 1993

Related U.S. Application Data

[63] Continuation-in-part of Ser. No. 996,024, Dec. 23, 1992, abandoned.

[51] Int. Cl.[5] ..... H04R 25/00

[52] U.S. Cl. ..... 600/25; 607/57; 181/130

[58] Field of Search ..... 600/25; 607/55–57; 623/10–11; 381/68, 68.3, 68.4, 68.6; 181/128, 129, 130, 134, 135

[56] References Cited

U.S. PATENT DOCUMENTS

| | | | |
|---|---|---|---|
| 3,712,962 | 1/1973 | Epley | 600/25 |
| 3,751,605 | 8/1973 | Michelson | 600/25 |
| 4,063,048 | 12/1977 | Kissiah, Jr. | 600/25 |
| 4,284,085 | 8/1981 | Hansen et al. | 128/420.6 |
| 4,357,497 | 11/1982 | Hochmair et al. | 128/420.6 |
| 4,617,913 | 10/1986 | Eddington | 600/25 |
| 4,696,287 | 9/1987 | Hortmann et al. | 600/25 |

*Primary Examiner*—Lee S. Cohen
*Assistant Examiner*—John P. Lacyk
*Attorney, Agent, or Firm*—Mirek A. Waraksa

[57] ABSTRACT

An implant produces an auditory response in the auditory nerve of a person's ear. The implant is a flexible, coiled strip of piezoelectric material dimensioned for insertion into the scala tympani of the ear in general alignment with the spiral path that the scala tympani follows. The length of the strip corresponds substantially to the full length of the scala tympani. The implant relies on the natural hearing mechanism of the ear. Sound vibration are transmitted along the normal pathways of the ear and are ultimately transmitted along the scala tympani. The vibrations induce a piezoelectric response in the material proximate to the basilar membrane, stimulating fibres of the auditory nerve along substantially the full spiral path of the cochlea. Perceived sound intensity can be adjusted with a hearing aid or other audio amplifier. Amplified sounds simply increase the intensity of the piezoelectric response of the implant and the intensity of the stimulus applied to auditory nerve fibres.

15 Claims, 4 Drawing Sheets

COCHLEAR IMPLANT

This is a continuation-in-part of application Ser. No. 07/996,024, filed Dec. 23, 1992 which is now abandoned.

FIELD OF THE INVENTION

The invention relates generally to human hearing, and more specifically, to methods and apparatus for producing an auditory response in a person with a hearing disorder.

DESCRIPTION OF THE PRIOR ART

The cochlea of the human car contains hair cells that appear essential to the perception of sound. These hair cells are found along substantially the full length of the spiral path followed by the cochlea. Sound vibrations distort certain structures of the cochlea which in turn distort the hair cells. It is believed that such distortion initiates electrical impulses in the hair cells. These impulses are conveyed to the fibres of the auditory nerve and ultimately to the brain. Some instances of human hearing loss are attributed to extensive destruction of the hair cells. The structures of the cochlea may otherwise be substantially intact, and the auditory nerve may be partially or completely intact, but auditory response is significantly impaired or non-existent.

An implant has been developed that can directly stimulate the auditory nerve in an individual with such hearing damage. The implant is essentially an electrode assembly comprising a silicone tube, electrodes extending from the exterior surface of the tube, and wiring extending through the tube's interior and connected to the electrodes. The tube is inserted through the round window membrane of the cochlea and extended along the scala tympani below the basilar membrane, proximate to fibres of the auditory nerve that enter the overlieing scala media. The electrode assembly is operated with a receiving unit internal to the individual's body and an external transmitting unit electromagnetically coupled to the receiving unit. The transmitting unit includes a microphone for detecting sounds, and circuitry for amplifying and processing the detected sound waveforms and transmitting corresponding signals to receiving unit. The receiving unit is connected to the wiring of the electrode assembly and activates the electrodes to stimulate fibres of the auditory nerve. The transmitting and receiving units are apparently programmable to permit selective activation of different electrodes, perhaps to different degrees, depending on the nature of the sound waves detected by the microphone of the transmitter. Basically, the stimulus applied to the auditory nerve can be adjusted.

There are several shortcomings to the prior implant. Its operation is very different from the natural hearing mechanism of the ear. The electrode assembly cannot stimulate auditory nerve fibres throughout the full length of the basilar membrane. A finite number of electrodes are involved, about twenty-one, allowing only stimulation at a limited number of points. That may account for reported limitations regarding sound frequencies that a user of the implant can perceive, and the need for extensive programming of the actuation of the electrodes. The programming is itself costly and requires repeated attendance of the patient. Another consideration is that the receiving unit must be anchored to bone in the human skull, which is preferably avoided, if possible. The transmitting unit is also bulky and must be secured with a headband, leading to user discomfort. Most significantly, the implant is destructive of cochlear structures. Physical separation of the transmitting and receiving units and implanting of the receiving unit ensure that the electrode assembly is not accidentally tugged or otherwise displaced by external forces. However, the electrode assembly is inherently large and invasive. It tends not to remain confined to the scala tympani, but tends to penetrate the basilar membrane. That may occur during installation, but even afterward there remains a risk that energetic movement by the individual may displace the electrode assembly inappropriately. The resulting damage to the cochlear structure may make replacement of the implant, or substitution of an improved implant that may be developed in future, difficult, if not impossible.

SUMMARY OF THE INVENTION

In one aspect, the invention provides an implant adapted to produce an auditory response in the auditory nerve of a person's ear. The implant comprises an elongate flexible strip of piezoelectric material dimensioned for insertion into the scala tympani of the ear in general alignment with the spiral path that the scala tympani follows. The strip may be coiled and its leading end may be rounded to facilitate insertion and threading along the scala tympani. The length of the strip preferably corresponds to the complete length of the scala tympani, approximately 30 millimeters (mm.). One face may be coated with a conductive material to enhance the piezoelectric response of the strip, the conductive material preferably being a metal that is non-reactive with human tissue.

The implant of the invention relies on the natural hearing mechanism of the ear. Sound vibration are transmitted along the normal pathways of the ear and are ultimately transmitted along the scala tympani. The vibrations induce a piezoelectric response in the material proximate to the basilar membrane, stimulating fibres of the auditory nerve. The stimulation is continuous along the length of the basilar membrane rather than pinpoint. The magnitude of the stimulation at various points along the basilar membrane is effectively modulated according to the frequency content of sounds received at the external ear and more closely approximates the stimulus applied to auditory nerve fibres in normal hearing, a matter discussed more fully below in connection with a description of a preferred embodiment. The implant may be used in conjunction with a hearing aid or another adjustable external sound amplification device. Amplified sounds are introduced into the external auditory canal, effectively amplifying the piezoelectric response of the implant and attendant stimulation of the auditory nerve. This allows for adjustment of perceived sound intensity. Unlike the prior art device, installation is comparatively simple and no long-term damage to the basilar membrane or other cochlear structures is expected.

Other aspects of the invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
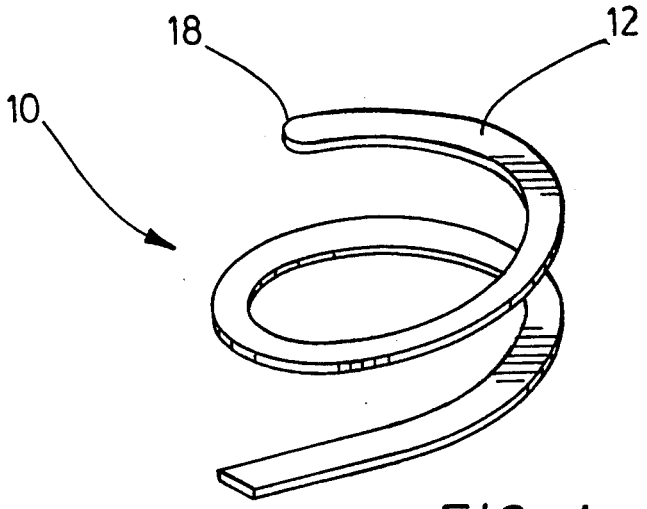
FIG. 1 is a perspective view of an implant embodying the invention.

Reference is made to FIG. 1 which illustrates an implant 10 embodying the invention. It comprises a strip 10 of piezoelectric material. There are essentially two criteria for selecting the material: first, it should be non-reactive with human tissues; and second, it is preferably characterized by a strong piezoelectric response. The preferred material is polyvinylidene fluoride, which is available from Pennwalt Corporation of the U.S.A. under the trade name KYNAR. One face of the strip 10 is formed with a gold coating 14 (indicated in FIG. 4), which is conductive and consequently enhances the piezoelectric effect and which is also non-reactive with body tissues. The cross-sectional dimensions of the strip 10 have been exaggerated in FIG. 4 for purposes of illustration.

Figure 3:
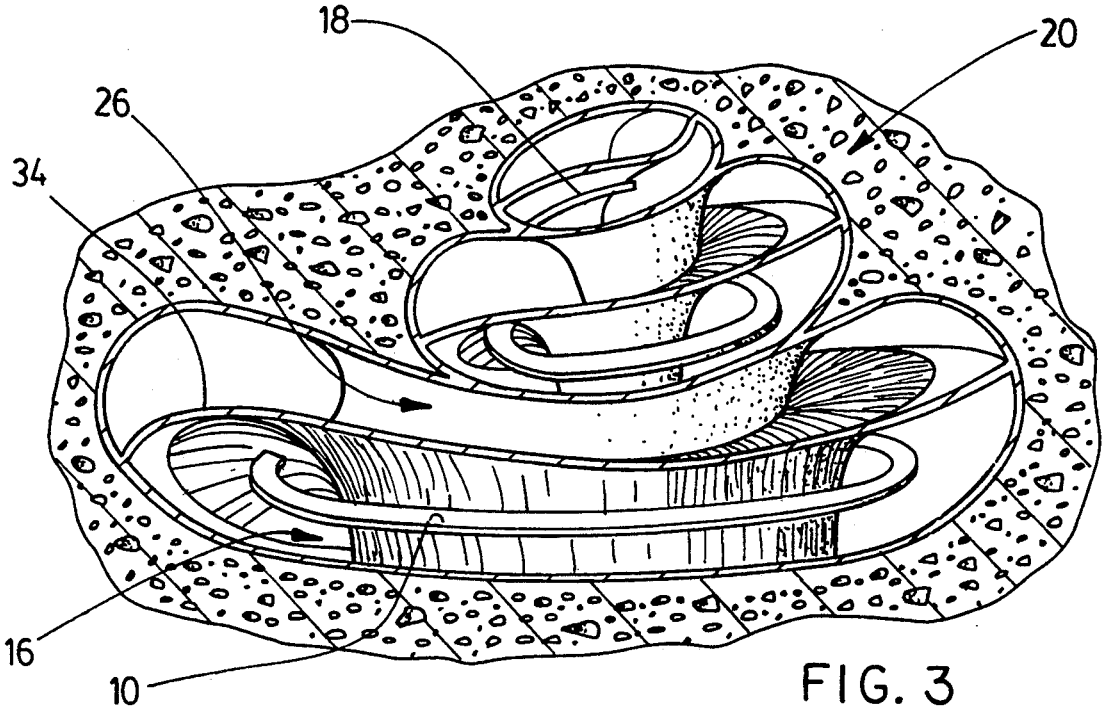
FIG. 3 is a fragmented diagrammatic representation of the human cochlea showing the implant in situ; and, FIG. 4 is a diagrammatic cross-section transverse to the spiral path of the cochlea showing the position of the implant relative to other cochlear structures.

The strip 10 conforms generally to the shape and dimensions of the scala tympani 16 of the human ear, as apparent in FIG. 3. Its length (along the spiral contour of the strip 10) is about 30 mm. which corresponds substantially to the full spiral length of the scala tympani 16 in an average individual. The width of the strip 10 is about 1.5 mm and its thickness between opposing faces is about 28 $\mu$m. It may simply be straight, and may be coiled as it is threaded into the scala tympani 16. However, it is preferably coiled into a spiral or helical form in advance (as in FIG. 1) to facilitate insertion into the spiral of the scala tympani 16. One end 18 of the strip 10 is rounded, to facilitate insertion and threading along the scala tympani 16. The strip 10 can be adjusted in length to suit a particular individual.

Figure 2:
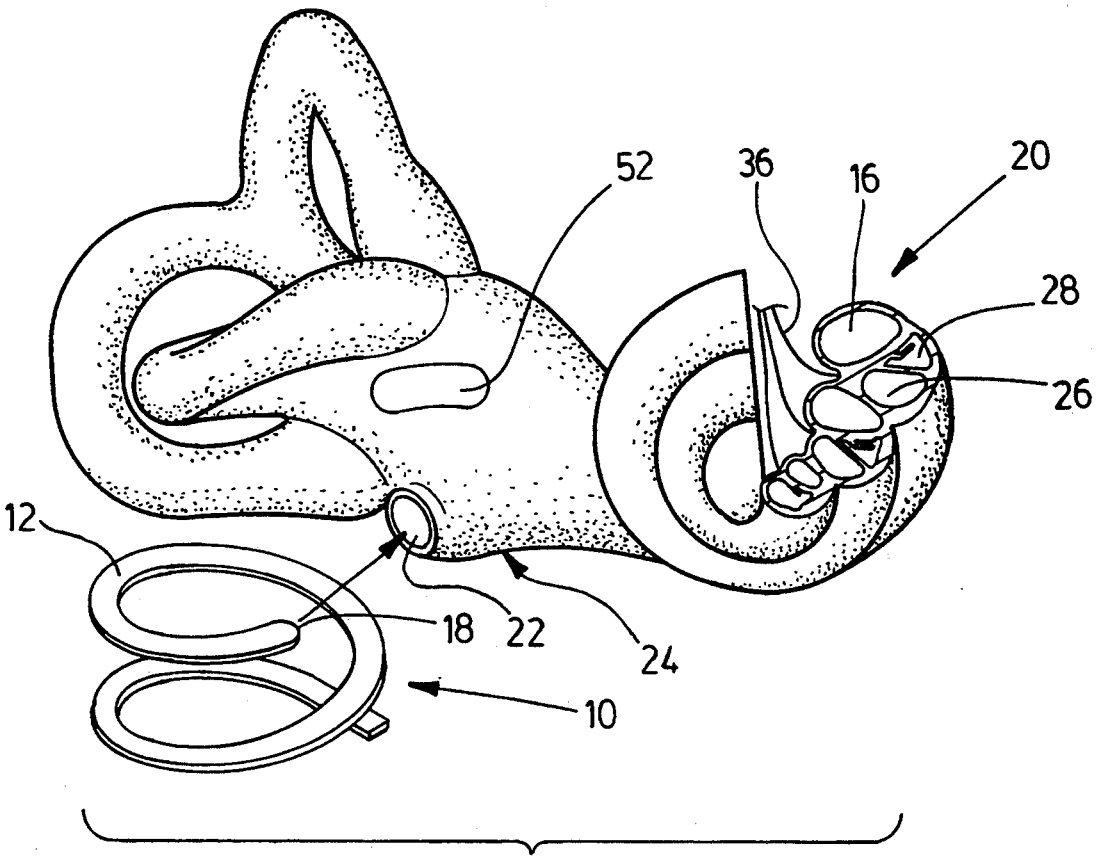
FIG. 2 diagrammatically illustrates the exterior of the human cochlea and points of insertion of the implant.
Figure 4:
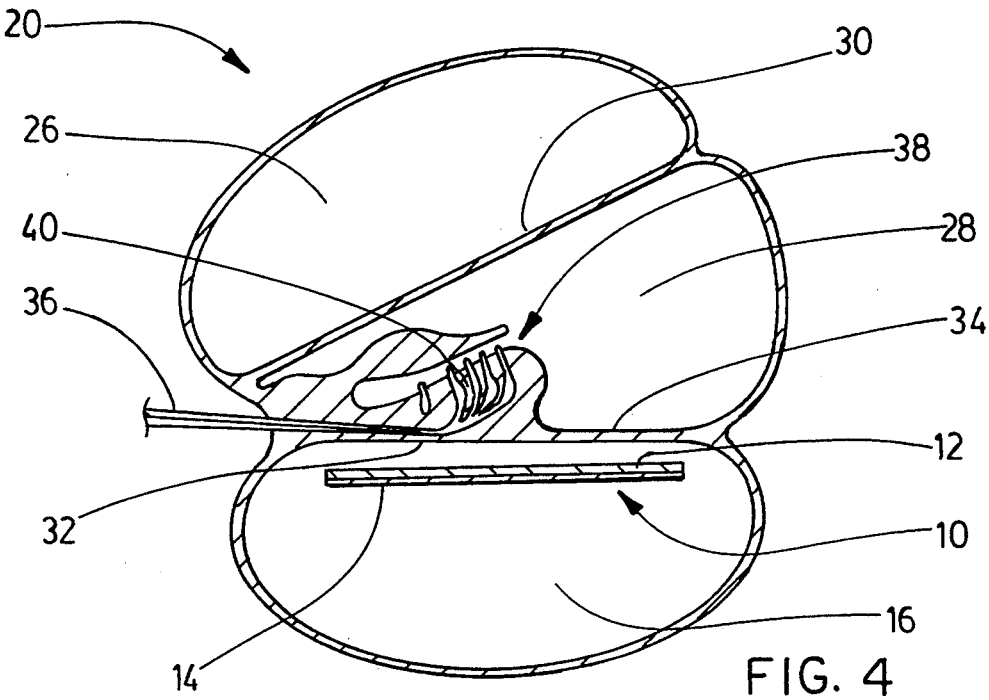

FIG. 2 provides a better overall view of the human cochlea 20 and different points of insertion of the implant 10. The implant 10 can be inserted through the round window membrane 22 terminating the scala tympani 16. Alternatively, to preserve the round window membrane 22, a hole may be drilled in bone adjacent to the round window membrane 22 to access the scala tympani 16, for example, at a region indicated generally with the reference numeral 24. The implant 10 may then be threaded along the length of the scala tympani 16, as shown in FIG. 4. The scala tympani 16 spirals through about two and one-half turns to the helicotrema (not illustrated), the small passage at the junction of the scala tympani 16 and scala vestibuli 26 at the apex of the cochlea 20. The implant 10 is preferably spiraled in alignment with the scala tympani 16 through at least two of its turns. Once insertion is complete, the access route is closed to return the cochlea 20 as nearly as possible to its normal state. The necessary surgical procedure will be readily apparent to those skilled in the art.

The position of the implant 10 relative to certain structures of the cochlea 20 will be more apparent in FIG. 4, which is a diagrammatic cross-section in a plane radially oriented relative to the cochlea 20. That view illustrates the scala tympani 16, the scala vestibuli 26, and the scala media 28 which is between the other two scalae 16, 26. Reissner's membrane 30 separates the scala vestibuli 26 from the scala media 28. The spiral lamina 32 and the basilar membrane 34 separate the scala media 28 from the scala tympani 16. The spiral lamina 32 contains the fibres of the auditory nerve 36. The organ of Corti 38 is shown rested on the basilar membrane 34 and contacted by the tectorial membrane 40 from above. The hair cells of the organ of Corti 38 are positioned between the basilar membrane 34 and tectorial membrane 40. The implant 10 is shown in transverse cross-section in the scala tympani 16 immediately below the spiral lamina 32 and the basilar membrane 34, somewhat enlarged relative to the cochlear structures illustrated. The conductive coating 14 of the implant 10 faces away from the basilar membrane 34 so that voltage potentials attributable to piezoelectric effects are created on the opposing face proximate to the basilar membrane 34. Those voltage potential stimulate the fibres of the auditory nerve 36 through the basilar membrane 34.

Figure 5:
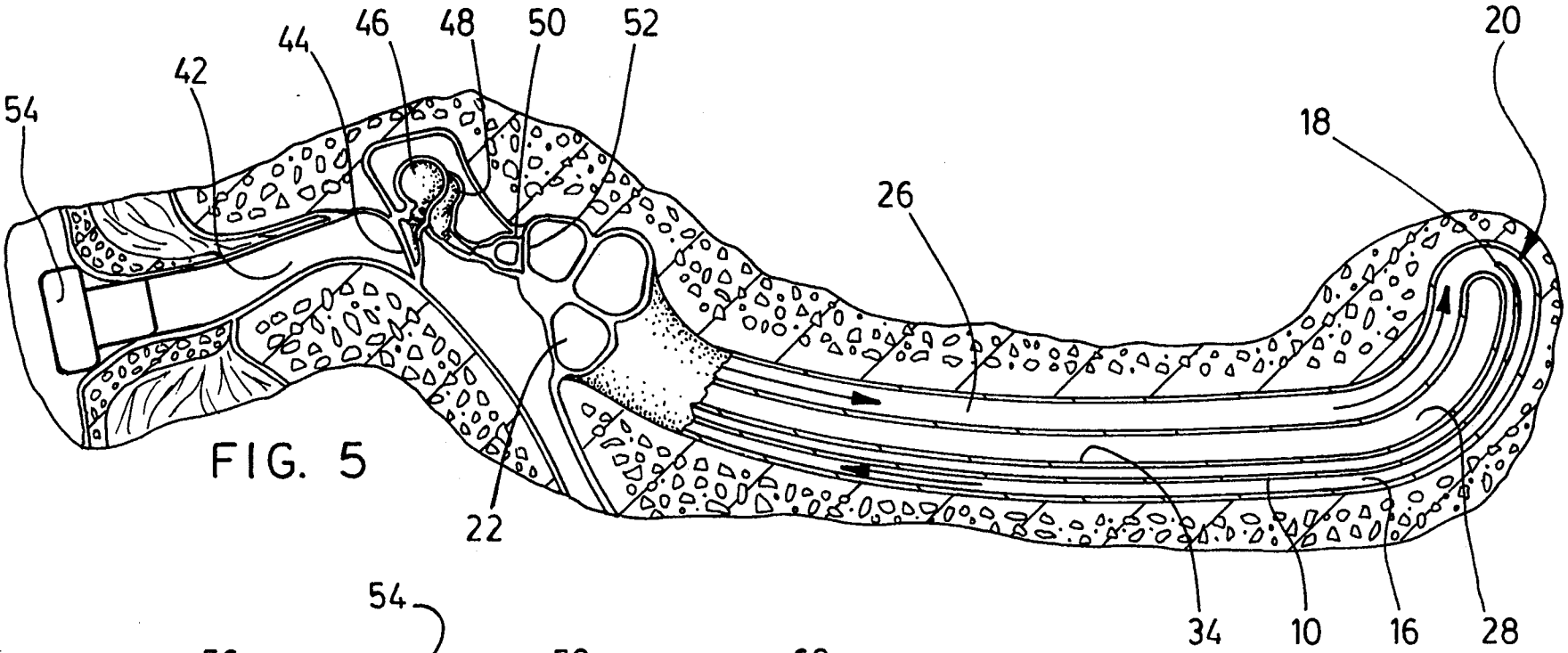
FIG. 5 is a fragmented diagrammatic representation of the ear, simplified to highlight sound transmission paths; and, FIG. 6 is a diagrammatic representation of an audio amplifier shown in FIG. 5.

How the implant 10 works will be explained with reference to FIG. 5 which shows more structure of the ear. The depiction of the cochlea 20 in FIG. 5 is entirely schematic, no attempt being made to show its convoluted spiral shape. The implant 10 is also shown in FIG. 5 extending in a straight-line fashion along the scala tympani 16 immediately below the spiral lamina 32 and the basilar membrane 34. The helical state of the implant 10 has not been shown in FIG. 5 in order to conform to the rendering of the cochlea 20. The object is to indicate in simplified form the paths along which sound vibrations are conducted and the mechanisms which respond. The path of sound vibrations is indicated with arrows.

Sound received at the ear is initially conveyed along the external auditory canal 42. The sound vibrates the tympanic membrane 44, which in turn rhythmically displaces the malleus 46, incus 48 and stapes 50. The stapes 50 transmits the sound vibrations through the oval window membrane 52 into the liquid filling the scala vestibuli 26. The vibrations are conveyed along the scala vestibuli 26 to the apex of the cochlea 20 and then along the scala tympani 16. The vibrations then travel along the scala tympani 16 to the round window membrane 22, causing movement of the membrane 22. This produces standing waves that distort the structures of the cochlea 20, and movement occurs between the tectorial membrane 40 and the hair cells of the organ of Corti 38. Several thousand such hair cells extend along substantially the full spiral path of the scala tympani 16, as do the fibres of the auditory nerve 36, neither of which are illustrated in FIG. 5. In the normal ear, this basic mechanism is believed to stimulate the hair cells and initiate electrical impulses that are ultimately perceived as sound.

Resonance characteristics of the structures of the cochlea 20 are believed instrumental to perception of different sound frequencies. High frequency sounds are known to result in a concentration of standing wave energy in the region of the scala tympani 16 proximate to the round window membrane 22, resulting in a greater stimulation of auditory nerve fibres in that region. Low frequency sounds tend to produce a concentration of wave energy at the opposite end of the scala tympani 16 and stronger stimulation of auditory nerve fibers in that region. Which nerve fibers are stimulated appears fundamental to differentiation between different sound frequencies. Depending on its exact frequency content, a particular sound would, in the normal ear, cause a particular distribution of standing wave energy within the scala tympani 16 and stimulation of different nerve fibers to different degrees. The implant 10 extends along substantially the full length of the scala tympani 16, and its piezoelectric response at any particular location is determined by the standing wave patterns occurring in the scala tympani 16. A stronger piezoelectric response is induced in those sections of the implant 10 where the natural hearing mechanism of the ear would otherwise produce a stronger stimulation of the auditory nerve fibres. The presence of the implant 10 will introduce some distortion of standing wave patterns, but its operation is consistent with the hearing mechanism associated with normal human hearing. This overcomes the problem of impaired frequency response associated with earlier implants and the need to program the response of an implant.

Figure 6:
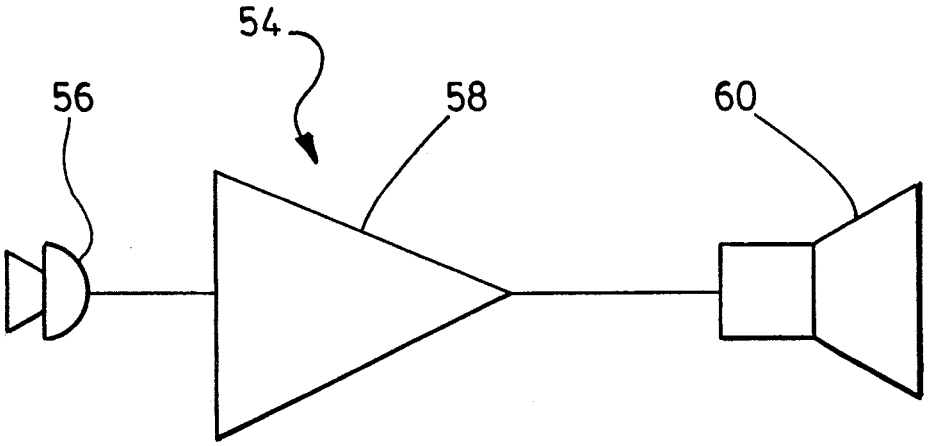

As mentioned above, it is desirable to select a material for the strip 10 that has a strong piezoelectric response in order to ensure that the fibres of the auditory nerves are adequately stimulated. However, because of the nature of the implant 10, the level of the stimulation, and consequently perceived sound levels, can be conveniently controlled with a variable-gain audio amplifier. As apparent in FIG. 5, a conventional hearing aid 54 may be inserted into the external auditory canal 42. It is diagrammatically represented in FIG. 6. A microphone 56 detects sounds and converts them into corresponding electric signals. The signals are amplified by a conventional variable-gain amplifier 58 operating in the hearing bandwidth, and are applied to a speaker 60 that directs the amplified sounds along the external auditory canal 42. The piezoelectric response of the strip 10 varies with the degree of mechanical deformation to which it is subjected, and, in this instance, in response to the amplitude of sound vibrations ultimately transmitted along the scala tympani 16 By varying the amplitude of sounds introduced into the external auditory canal 42, the intensity of the piezoelectric response and consequently the degree to which fibres of the auditory nerve 36 are stimulated can be adjusted. This in turn controls perceived sound levels.

Figure 7:
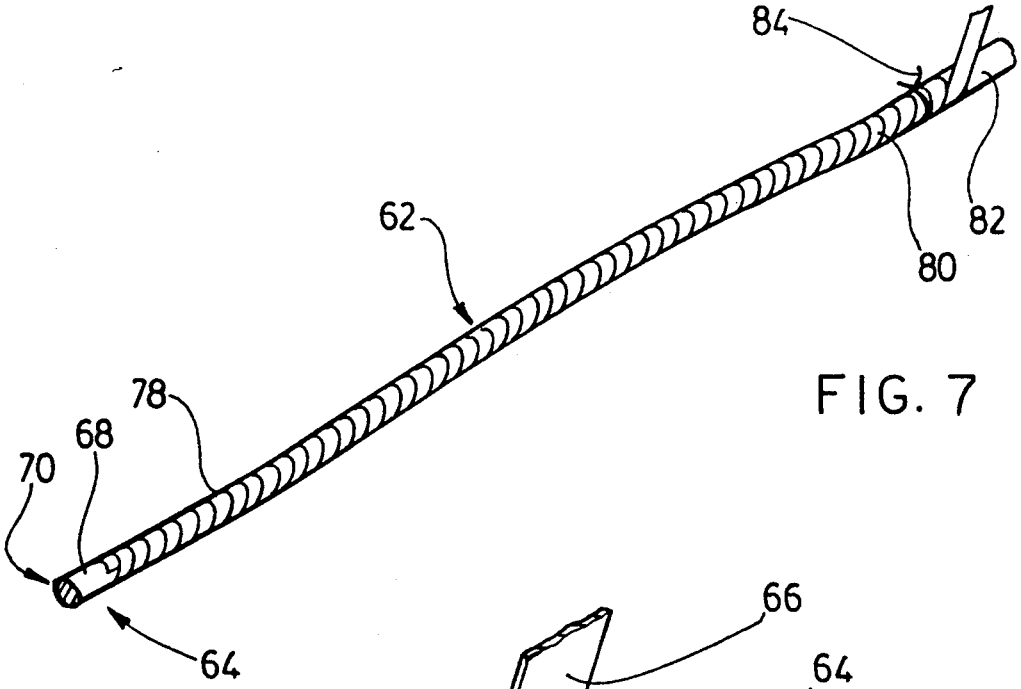
FIG. 7 is a perspective view of alternative implant apparatus embodying the invention.
Figure 8:
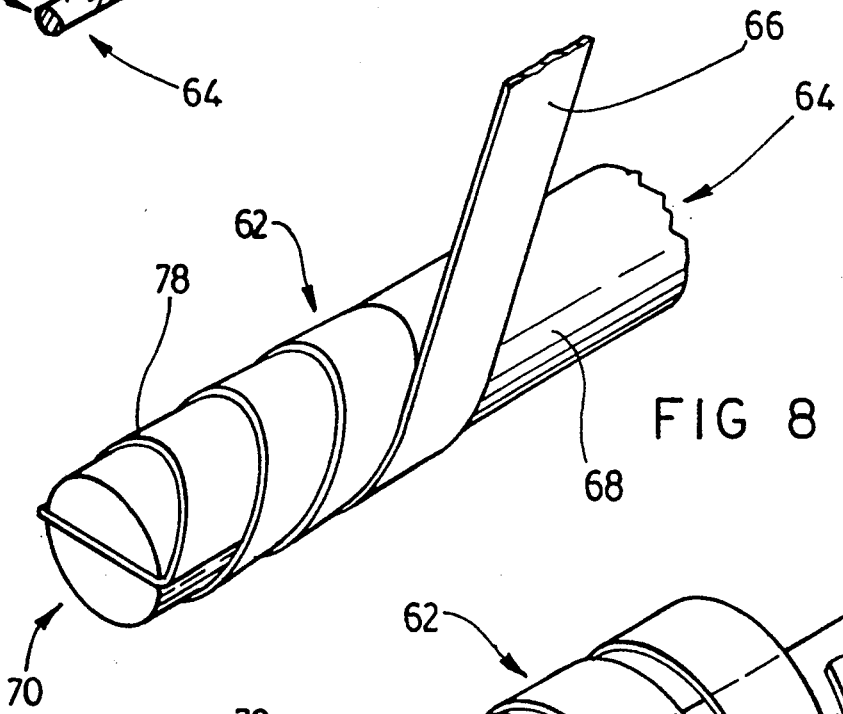
FIG. 8 is an enlarged, fragmented perspective view of a forward end of the implant apparatus of FIG. 7; and, FIG. 9 is a view comparable to that of FIG. 8 showing how a piezoelectric strip associated with the apparatus of FIG. 7 releases from a support used to install the piezoelectric strip within the cochlea.
Figure 9:
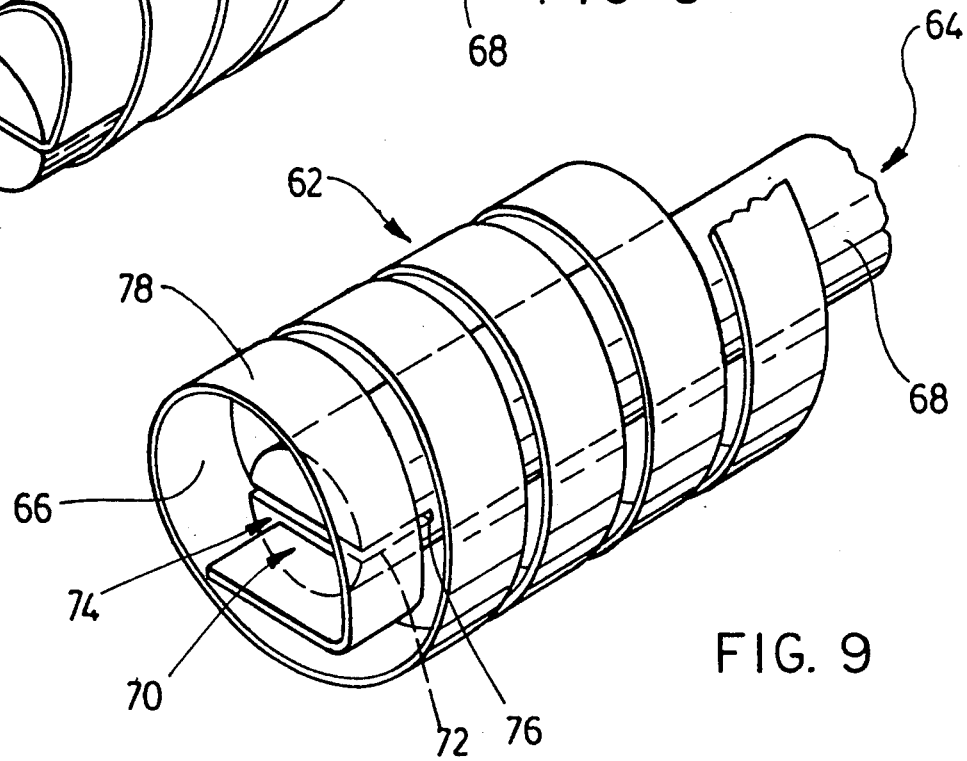

FIGS. 7–9 illustrate implant apparatus comprising a piezoelectric strip 62 and a support 64 that facilitates location of the strip 62 along the scala tympani 16. The piezoelectric strip 62 is substantial identical to that described above. It has the same cross-sectional dimensions, but a significantly greater length. The length is not critical since, in this embodiment of the invention, the piezoelectric strip 62 is cut to an appropriate length after insertion into the scala tympani 16. One face 66 of the piezoelectric strip 62 is covered with a conductive coating which has not been separately illustrated in the drawings.

The support 64 is a flexible plastic filament with a length of about 5 centimeters. It has a diameter appropriate to allow insertion through the round window membrane 22 and displacement along the scala tympani 16. It is sufficiently flexible that it conforms readily to the spiral path of the scala tympani 16, during insertion, but sufficiently rigid to allow pushing of the support 64 lengthwise along the scala tympani 16. A preferred filament meeting such requirements is available under the trade mark PROLENE from Ethicon Inc., U.S.A., and is designated as size "0." It is formed of polypropylene and has a diameter that is roughly 0.35 to 0.40 millimeters. To facilitate insertion and displacement, the forward end of the support 64 may be rounded by exposure to an electrical heating element.

The piezoelectric strip 62 is secured to the support 64 in a manner that allows displacement together along the scala tympani 16 and selective releasing of the piezoelectric strip 62 from the support 64 once the piezoelectric strip 62 is oriented as desired. To that end, a simple retaining structure 70 is formed on a forward end portion 66 of the support 64. The retaining structure 70 comprises a slot 72 which extends transversely through the support 64 and which is dimensioned to loosely receive the piezoelectric strip 62. The slot 72 has an open forward end 74 and a blind rear end 76 within the support 64. The slot 72 may be formed with a scalpel or other tool.

A forward end portion 78 of the piezoelectric strip 62 is inserted through the slot 72, transverse to the length of the support 64. The piezoelectric strip 62 is wound tightly about the exterior of the support 64, as illustrated in FIG. 8. The coated face 66 of the piezoelectric strip 62 is laid against the exterior of the support 64 during such winding. The rear end portion 80 of the piezoelectric strip 62 is tied with surgical thread 84 to a rear end portion 82 of the support. Surgical thread 84 serves as a convenient releasable fastener for purposes of the invention, since a surgeon installing the implant will normally have a scalpel or other bladed tool available to release the thread 84. More complex fasteners such as clamps or clips may be used, but these are unnecessary for purposes of the invention. The winding of the strip 62 about the support 64 together with the securing of the rear end portion 80 of the strip 62 to the support 64 maintain the forward end portion 78 of the strip 62 in the retain structure until the thread 84 is released by cutting.

How the support 64 is used to install the piezoelectric strip 62 will be largely apparent from the foregoing description. An opening is made in the round window membrane 22. The support 64 together with the piezoelectric strip 62 is advanced along the scala tympani 16 until the forward end of the support 64 reaches the helicotrema. The surgical thread 84 securing the piezoelectric strip 62 to the support 64 is then cut. This effectively releases the piezoelectric strip 62 from the support 64, and allows the piezoelectric strip 62 to expand radially under its inherent resilience, substantially as illustrated in FIG. 9. The support 64 can then be separated from the piezoelectric strip 62 by displacement rearwardly in the direction indicated with an arrow in FIG. 9 and withdrawn entirely from the scala tympani 16. The forward end portion 78 of the piezoelectric strip 62 simply escapes through the open forward end 74 of the slot 72. The piezoelectric strip 62 may then be cut at the round window membrane 22, and the cut end pushed into the scala tympani 16. The piezoelectric strip 62 may, however, be cut before withdrawal of the support 64. The incision in the round window membrane 22 is then closed.

The overall orientation of the piezoelectric strip 62 is then comparable to that of the piezoelectric strip 12, as illustrated in FIG. 3, in general alignment with the spiral path of the scala tympani 16. The principal difference is that the piezoelectric strip 62 spirals as it extends along the scala tympani 16. This does not impair operation, and it will be noted that the coated face 66 once again faces away from the basilar membrane. The piezoelectric strip 62 may once again be used in combination with a hearing aid amplifier substantially in the manner described above. The amplification factors will generally be higher than those associated with conventional hearing aids in order to ensure generation of an appreciable piezoelectric effect and auditory response.

It will be appreciated that particular embodiments of the invention has been described and that modifications may be made therein without departing from the spirit of the invention or necessarily departing from the scope of the appended claims.

I claim:

1. An implant adapted to produce an auditory response in the auditory nerves of a person's ear in response to sound vibrations conducted along the scala tympani of the ear, comprising:
   an elongate flexible strip of piezoelectric material dimensioned to be inserted into the scala tympani of the ear in general alignment with the spiral path of the scala tympani, the strip having a pair of opposing faces; and,
   a coating of electrically-conductive material formed over one of the faces of the strip.

2. The implant of claim 1 in which the strip has a length of about 30 millimeters.

3. The implant of claim 1 in which the strip is wound into a helix.

4. The implant of claim 1 in which the strip has a pair of opposing ends, one of the ends being rounded thereby to facilitate insertion along the scala tympani.

5. The implant of claim 1 in combination with:
   an elongate flexible support for locating the strip within the scala tympani, the support being dimensioned for displacement lengthwise along the scala tympani and being sufficiently rigid that the support can be pushed along the scala tympani; and,
   securing means securing the strip to the support for displacement together and selectively operable to release the strip from the support.

6. Apparatus for producing an auditory response in the auditory nerves of a person's ear, comprising:
   a microphone adapted to produce an electronic signal corresponding to sounds impinging on the microphone;
   an amplifier connected to the microphone for amplifying the electronic signal;
   a speaker connected to the amplifier for transforming the amplified electronic signal into amplified sounds, the speaker comprising a housing adapted to be inserted into the ear to direct the amplified sounds into the external auditory canal of the ear; and,
   an implant comprising an elongate flexible strip of piezoelectric material dimensioned to be inserted into the scala tympani of the ear in general alignment with the spiral path of the scala tympani;
   whereby, in use, the amplified sounds cause vibrations to be conducted along the scala tympani thereby inducing a piezoelectric response in the material and stimulation of auditory nerve fibres.

7. The apparatus of claim 6 in which the strip has a length of about 30 millimeters.

8. The apparatus of claim 6 in which the strip is wound into a helical shape.

9. The implant of claim 6 in which:
   the strip comprises a pair of opposing faces; and,
   a coating of electrically-conductive material is formed over one of the pair of faces.

10. A method of producing an auditory response in the auditory nerves of a person's ear, comprising inserting a strip of piezoelectric material into the scala tympani of the ear in general alignment with the spiral path of the scala tympani, whereby sound vibrations conducted along the scala tympani produce a piezoelectric effect in the strip thereby stimulating the auditory nerves.

11. The method of claim 10 comprising:
   amplifying sound that occurs externally of the ear; and,
   applying the amplified sound to the external auditory canal of the ear.

12. The method of claim 10 in which the step of inserting the strip comprises:
   securing the strip to an elongate flexible support;
   inserting the support into the scala tympani and pushing the support lengthwise together with the secured strip along the scala tympani until the strip is substantially in a required orientation along the length of the scala tympani;
   releasing the strip from the support after the strip is in the required orientation; and,
   withdrawing the support from the scala tympani after the strip is released.

13. Apparatus for producing an auditory response in the auditory nerves of a person's ear in response to sound received by the ear, comprising:
   an elongate flexible strip of piezoelectric material dimensioned for location within the scala tympani of the ear in general alignment with the spiral path of the scala tympani;
   an elongate flexible support for locating the strip within the scala tympani, the support being dimensioned for displacement lengthwise along the scala tympani and being sufficiently rigid that the support can be pushed along the scala tympani; and,
   securing means securing the strip to the support for displacement together and operable to release the strip from the support.

14. The apparatus of claim 13 in which:
   the support comprises a forward end portion and an opposing rear end portion;
   the strip comprises a forward end portion and an opposing rear end portion; and,
   the securing means comprise a retaining structure located on the forward end portion of the support and shaped to loosely receive the forward end portion of the strip in an orientation transverse to the length of the support, the strip being tightly wound around the support thereby to keep the forward end portion of the strip within the retaining structure, and comprise a fastener securing the rear end portion of the strip to the rear end portion of support thereby keeping the strip tightly wound about the support until the fastener is released.

15. The implant apparatus of claim 14 in which the retaining structure defines a slot extending transversely through the support, the slot having an open forward end and a blind rear end.

* * * * *